US005613263A

United States Patent [19]

Nolte

[11] Patent Number: 5,613,263

[45] Date of Patent: Mar. 25, 1997

[54] CLEANING CLOTH

[75] Inventor: Werner Nolte, Nohen, Germany

[73] Assignee: Metaform Metallverabeitungsgellschaft mbH Industriegebiet, Weiersbach, Germany

[21] Appl. No.: 360,773

[22] PCT Filed: May 19, 1993

[86] PCT No.: PCT/EP93/01246

§ 371 Date: Dec. 22, 1994

§ 102(e) Date: Dec. 22, 1994

[87] PCT Pub. No.: WO94/24922

PCT Pub. Date: Nov. 10, 1994

[30] Foreign Application Priority Data

Apr. 29, 1993 [DE] Germany ..... 43 14 154.4

[51] Int. Cl.[6] ..... A47L 13/20

[52] U.S. Cl. ..... 15/228; 15/229.1; 15/229.4; 15/229.8; 15/233

[58] Field of Search ..... 15/223, 226, 228, 15/229.1–229.9, 231–233

[56] References Cited

U.S. PATENT DOCUMENTS

| | | | |
|---|---|---|---|
| 1,178,069 | 4/1916 | Grant | 15/228 |
| 1,202,334 | 10/1916 | Van Dyne | 15/229.1 |
| 1,259,617 | 3/1918 | Grant | 15/229.8 |
| 1,339,925 | 5/1920 | Grant | 15/228 |
| 1,420,180 | 6/1922 | Casmire | 15/229.4 |
| 1,660,062 | 2/1928 | Barber | 15/229.8 |
| 2,490,224 | 12/1949 | McDermott | 15/229.8 |
| 2,631,324 | 3/1953 | Du Four | 15/229.3 |
| 3,333,293 | 8/1967 | Skurdelis | 15/233 |
| 4,845,800 | 7/1989 | Pederson et al. | 15/228 |
| 5,115,535 | 5/1992 | Ferre | 15/229.7 |

FOREIGN PATENT DOCUMENTS

| | | | |
|---|---|---|---|
| 0358844 | 3/1990 | European Pat. Off. . | |
| 3139245 | 4/1983 | Germany . | |
| 9016501 | 7/1991 | Germany . | |
| 9200370 | 4/1992 | Germany . | |
| 4-197328 | 7/1992 | Japan . | |
| 736847 | 9/1955 | United Kingdom | 15/229.4 |
| 8805642 | 8/1988 | WIPO . | |

*Primary Examiner*—Mark Spisich

*Attorney, Agent, or Firm*—Brumbaugh, Graves, Donohue & Raymond

[57] ABSTRACT

A cleaning cloth for stretching onto a wiper frame intended for such a cleaning cloth, with pockets for receiving the opposite stretching bow ends (S), and is distinguished by a bead or stiff edge (18) which extends along the longitudinal sides of the cleaning cloth and lies to the outside relative to a seam (16) parallel to the cloth, and by a bead (20) which lies to the inside relative to the seam (16), said seam (16) forming a sort of tilting articulation for the stiffening (18; 20) consisting of the two beads.

16 Claims, 3 Drawing Sheets

CLEANING CLOTH

BACKGROUND OF THE INVENTION

The invention relates to a cleaning cloth for stretching onto a wiper frame intended for such a cleaning cloth, with pockets for receiving the opposite stretching bow ends.

Known cleaning cloths of this type are either provided with fringes at the edge, are simply stretched over the bow, or protrude via an edge approximately 5 cm beyond the frame edges on all sides.

Cleaning cloths protruding only a short distance beyond the bow edges have been in use for over 25 years, in another construction. The stretching frames also generally belong to the prior art and are everywhere commercially available, so that they are not described in any detail here. The wiper frames are generally introduced in the bent state into the pockets and are then straightened into their extended stable position.

It has now emerged that known stretch cloths were not able to provide adequate wiping in the actual comer area. They were also made up of a plurality of materials (the pockets too were made of fairly rigid plastic), which fact led to difficulties during recycling, due to the sorting out of the various materials, and also brought with it environmental problems due to the high proportion of plastic.

SUMMARY OF THE INVENTION

The object of the invention is to pick up dust and dirt more efficiently than in the case of previous cleaning cloths, and also to provide for better cleaning in the corner areas at the baseboard, without the person who is doing the cleaning having to stoop to any extent and clean these areas possibly with an extra cloth.

This is achieved surprisingly simply by a bead (stiff edge) which lies along the edges of the cleaning cloth and to the outside relative to a seam parallel to the cloth edges, and by a bead which lies to the inside relative to the seam, said seam forming a sort of tilting articulation for the stiffening consisting of the two beads.

The cleaning cloth is preferably turned back on itself at least twice at the edge and stitched, the resulting outer bead being at least three-layered, and the resulting inner bead being at least two-layered.

The width of inner bead and/or outer bead amounts to approximately 2 cm relative to the seam in a preferred embodiment.

The best results have been obtained when the seam was turned back twice and sewn 1 to 2 cm away from the edge. This results in a stiff edge, a kind of bead, which protrudes into the corner and, by means of the firm edge, picks up the dust and dirt more efficiently than do the previously known cleaning cloths. The edge is so firm and short that it does not turn back on itself.

The advantage over previously known cleaning cloth edges which turn back on themselves, and in which the cleaning cloth can lift up on the baseboard and in so doing leave a gap in the corner, lies in the fact that the resulting bead, formed by the double or multiple turn-back and the close seam, guarantees optimal cleaning in the corner.

The multiple turn-back results in a relatively stiff construction which consists of outer bead, inner bead and seam and which forms a sort of tilt when the seam is applied on the bow.

As the bow is pushed in and slips under the inner bead, it presses this "tilt" outward about the seam and thus guarantees an optimal cleaning.

The fact that the pockets consist of the same material as the cloth (the cloth is sewn in once or in several layers for strengthening) affords a considerable advantage from the point of view of environmental technology.

The fact that the seam runs approximately in the center of the double or multiple turn-back at the edge results in a space between the lower bearing surface and the bead so that the bow, during cleaning, can be pushed under the bead from the inside (under the inner bead) and thus prevents the cloth from turning upward, as is still the case with known cloths.

The fact that the edges of the cleaning cloth are particularly stiff prevents the dirt from being simply pushed to and fro.

By means of the application of the stretching frame, a downward pressure automatically occurs when contact is made with a wall or baseboard, so that an optimal cleaning effect can be obtained in the corners, where the wall or baseboard meets the floor at an angle of approximately 90°.

In addition, the fact that the stretching frame protrudes into the bead guarantees that said frame does not come into contact with furniture or the like, and damage is thus ruled out.

Moreover, the construction according to the invention is not on the whole as stiff as would be the case if plastic were used for the pockets. Wringing out is easier, and the force exerted considerably less.

In another embodiment, the cleaning in the corners is improved by virtue of the fact that the cleaning cloth has a trapezoidal configuration with the longest leg of the trapezoid at the bottom edge thereof. Particularly in the case when the room had undercuts, when corners of less than 90° were to be cleaned, this configuration, which is trapezoidal in cross-section, of the stretch cloth or pile has the advantage, compared to the known products, that, even in the case of walls with negative offsets, an optimal cleaning of these corners can be achieved.

In a development of the invention, the cleaning cloth can have a spacer on one side of which, for example the upper side, there is a long pile, and on the other side of which, for example the underside, there is a short pile.

Pockets are situated at opposite ends of the cleaning cloth as before on both sides.

Thus, by simply turning the cleaning cloth round, it is possible on the one hand to act on coarse dirt and on the other hand to act on fine dirt.

In a development of the invention, a band of elastic material such as rubber is stitched into the pockets. By this means, the fit is even tighter, and the stretching more elastic.

A turned-back end of the rubber band can be stitched on the main body, for example of the long pile, and the other end can be stitched through the spacer, for example to the second pile side.

The rubber band can be sewn-in in two layers, the inner layer being shorter than the outer layer. By this means it is possible to ensure that the arrangement is particularly elastic, since first the inner layer of the rubber band is stretched, and then the outer layer is stretched too in order to ensure a better hold.

It is of course not impossible for the upper side and underside of the cloth to have the same properties.

Two such floor-cleaning cloths can simply be secured with their backs toward each other and with a spacer between them.

The rubber band provides for a tight fit of the floor cloth on the holder, which as before is introduced into the pockets.

The same structure on the upper side and underside contributes to the fact that the cloth can clean or dry twice the surface area. The useful life of the cloth can also be prolonged in this way, and cleaning in the comers is improved. The tight fit of the cloth ensures quick working. The uptake of water when cleaning and when wiping dry is very good.

BRIEF DESCRIPTION OF THE DRAWINGS

Illustrative embodiments of the invention will now be explained in greater detail with reference to the attached drawings, in which.

DESCRIPTION OF PREFERRED EMBODIMENTS

Figure 1:
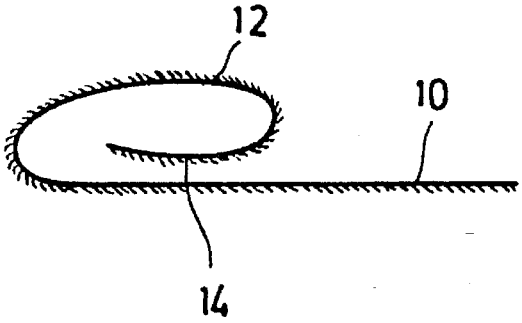
FIG. 1 shows a cleaning cloth tuned back several times.

The cloth 10 according to FIG. 1 is turned back upon itself once at 12, and is then turned back upon itself a second time. This cloth 10 also serves to form the pockets.

Figure 2:
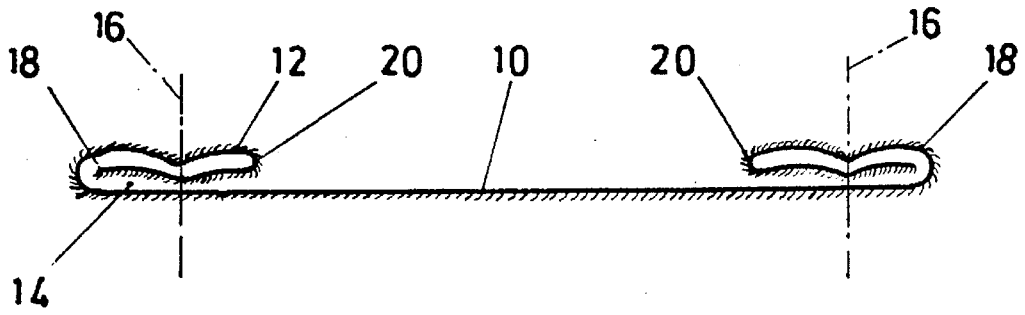
FIG. 2 shows such a cloth provided with a seam.

FIG. 2 shows how the cloth is turned back twice, finished, needled and thus stiffened. An outer bead is formed at 18, and an inner bead at 20.

Figure 3:
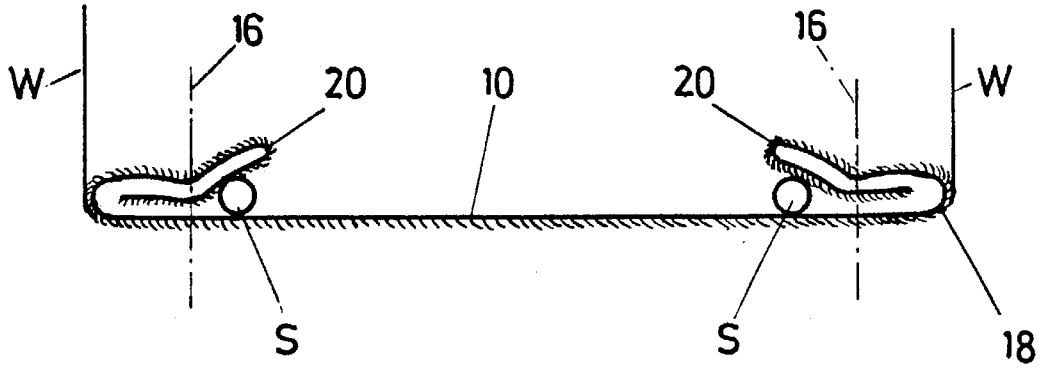
FIG. 3 shows such a cloth with stretching frame.

FIG. 3 shows the construction after introducing the stretching frame or stretching frame bow S. It can be seen that, by means of the stiffening about the seam 16, a tilting arrangement has been formed which is the result of the inner bead and outer bead 18; 20 and which pivots about the seam when the bow S is introduced and when contact is made against the wall. As a result of the construction which has been formed, the bow S engages under the bead 20 and thus constantly presses the outer bead 18 downward. The reference W indicates the wall, against the corner of which, formed by the baseboard, the short and stiff bead makes contact. As has been stated, by means of pressing against the wall, the stretching frame is pushed under pile or cleaning cloth and (bead 20) pushes the bead 18 protruding beyond the stretching frame S downward so that the latter can no longer turn upward.

Figure 4:
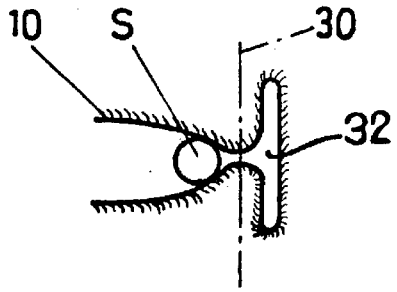
FIG. 4 and FIG. 5 are alternative embodiments.
Figure 5:
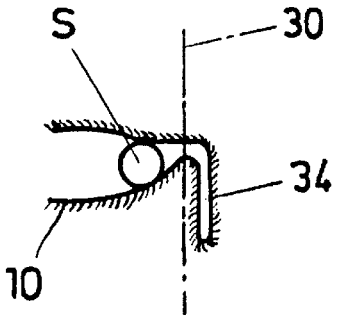

Another construction is shown in FIGS. 4 and 5. Here, from the material (coat) of the cleaning cloth which itself lies horizontally, a kind of pocket or strip 32 is formed by stitching at 30, said pocket or strip 32 being perpendicular to the plane of the horizontal bead, in other words vertical. According to FIG. 4, this "tilt strip" 32 protrudes upward and downward tilting about the seam 30, while according to FIG. 5 it protrudes only downward at 34. This vertical strip can be stiffened in any desired way, for example by needling, gluing, sticking or the like, in order to remain in its position. An insert is similarly possible. In further embodiments, this vertical strip can also have a concertina-like design.

Figure 6:
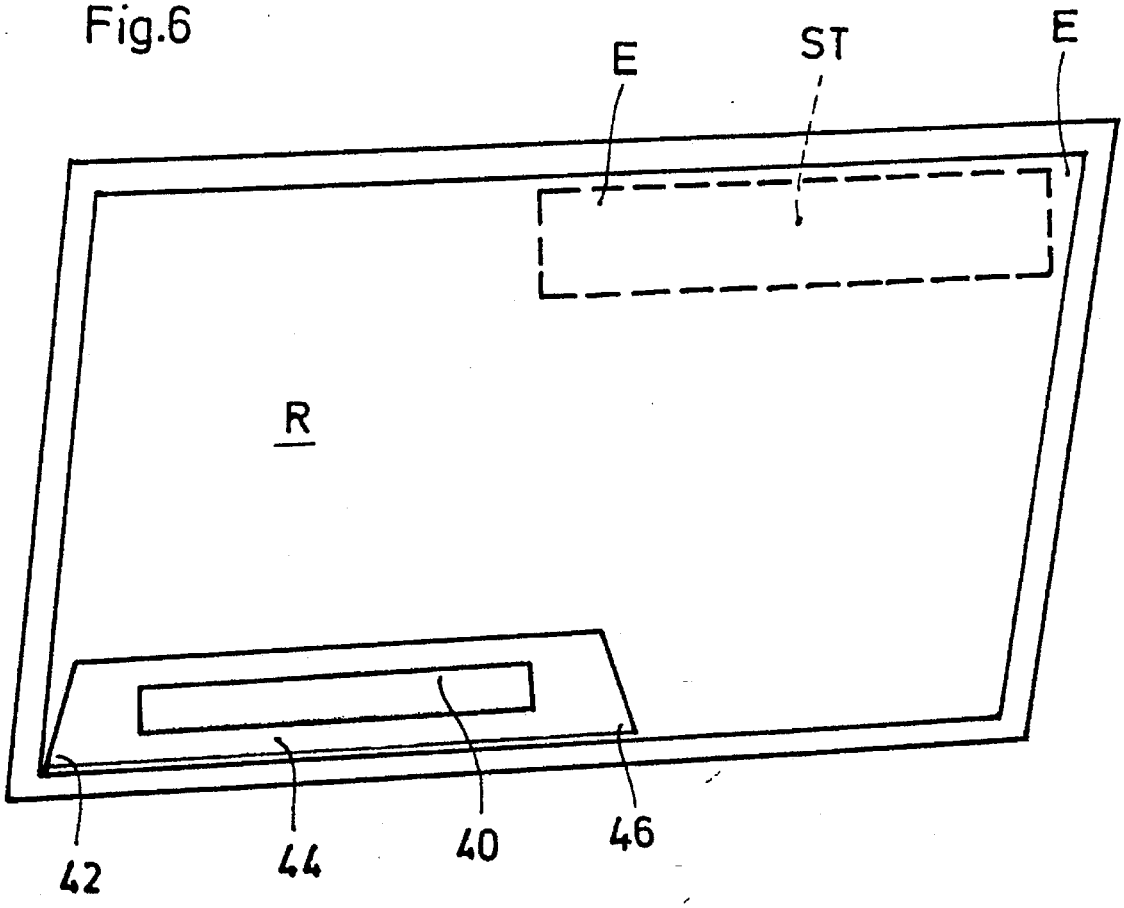
FIG. 6 shows a construction for special corner cleaning.

Finally, FIG. 6 shows another construction. The cleaning action with known constructions is shown in a room R. The room R has, for example, a configuration with corners of less than 90°. Here, the cleaning cloth ST does not reach into the comer E, and this area therefore remains uncleaned.

In contrast, according to the invention, a cleaning cloth 40 is here proposed which has a trapezoidal configuration with the longest leg of the trapezoid at the bottom. With the point or edge it is possible to fill the comers completely, the base part 44 nevertheless lying fully flat. The cleaning bow can in this case have a round or rectangular or square cross section. Even in the case of walls with negative offsets, as shown in FIG. 6, an optimal cleaning of this comer can be achieved.

The cleaning cloth according to the invention can be made on the basis of knitwear, in particular warp knit, and although weft knit should not be excluded, it is nevertheless employed less often for industrial purposes.

The cleaning cloth can also have a pile which is configured in a particular manner. A fiber of particular property is used, namely fibers having a sawtooth-like effect or sawtooth-like configuration. The outcome of this is that only 5% of the previously required cleaning agent need be used to obtain a good result.

In a particular development of the invention, a smooth fiber is closely associated with each sawtooth-like fiber. This association may be loose, may consist of a twisting or of a twisting and bonding. Furthermore, depending on the requirements, cotton can be used in addition to the synthetic fibers.

The back of the support material can be prepared by addition of chemical agents in such a way that the fibers bond to the support material on heating or by means of this agent.

The fact that two fibers of completely opposite design are used results in a highly desirable combination effect: the saw-type fibers will tear up the film of dirt, including fats and oils. A special effect is achieved by means of this interaction between two fibers of different manufacture and design. By their nature, these sawtooth-type fibers have an enormously high capillary action and thus a high water absorption capacity, but they release this water only slowly: the smooth fiber, in contrast, can, by means of its capillary action, take up the dislodged film of dirt or fat and, upon contact with liquid, deposit this film on this saw-type fiber which conveys it upward (outward). The cause of this effect is not yet clear: it is assumed that, since the support material is impervious to water and air and causes a suction upon release of water, the dirt is sucked easily upward on the smooth fiber so that an extremely large surface area can be cleaned with a very low water consumption. This in turn has the consequence that the users only seldom have to wash out the stretch cloth, which makes their work much easier.

In a particular embodiment, the pile of the cleaning cloth can consist of 50% cotton fibers and 50% synthetic fibers. Thermoplastic fibers will generally be used both as smooth fibers and as sawtooth-type fibers.

Figure 7A:
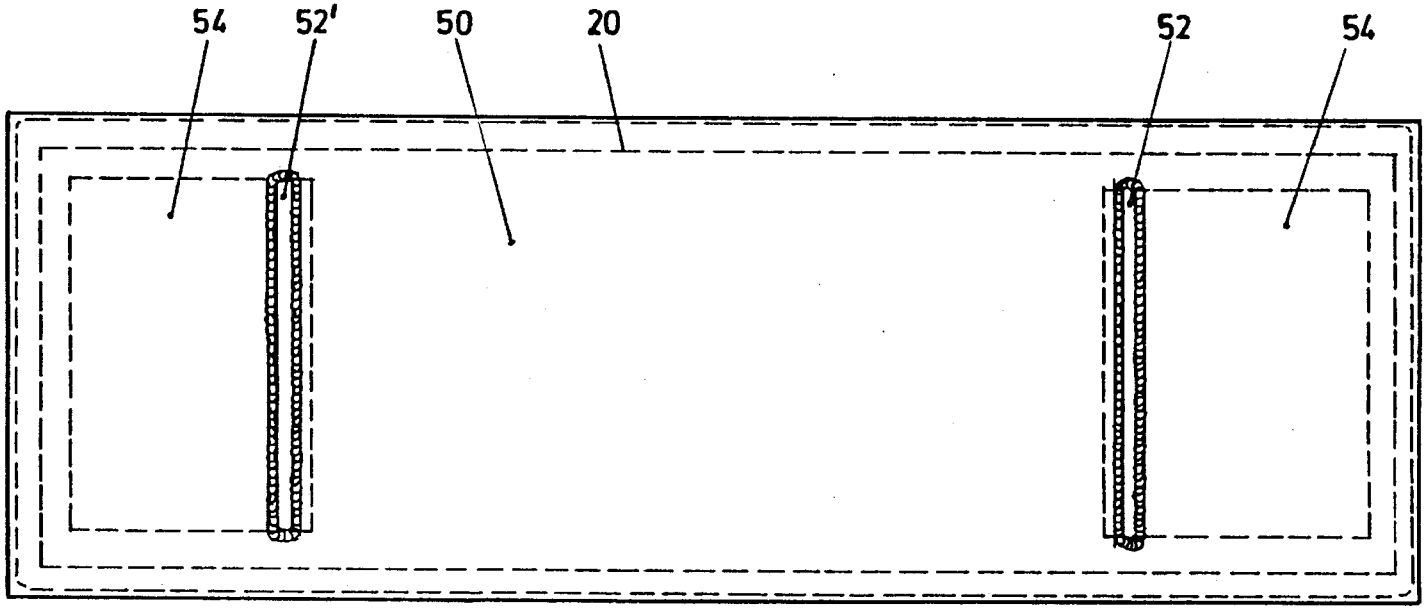
FIGS. 7A–7C show a further embodiment, FIG. 7A in plan view, FIG. 7B in front view, and FIG. 7C a section through the longitudinal mid-plane of FIG. 7A.
Figure 7B:
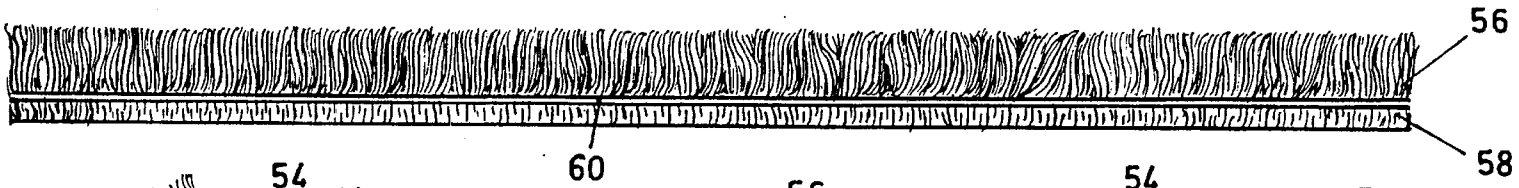
Figure 7C:
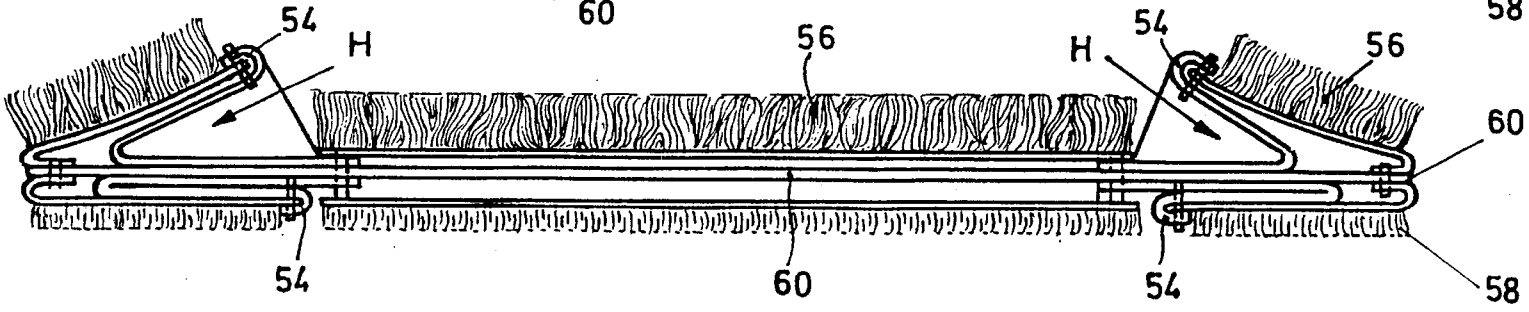

FIGS. 7A–7C show a double floor cloth which, according to the illustration, can be provided with a long pile 56 and a short pile 58. However, the two piles can also be similar and of similar properties.

The pockets 52 and 52' are designed and flanged as before. A novel feature is that a rubber band 54 is sewn into the pockets. The inner and outer seams are shown again by broken lines. As before, the holder is pushed into the pockets 52 and 52'.

As FIG. 7B clearly shows, a spacer, designated by 60, is provided between upper and lower pile.

In a development of the invention, as can perhaps be seen more clearly in FIG. 7C, one cleaning cloth is provided on top and one underneath and they are stitched via the spacer 60. The rubber band 54 can be stitched with a turned-back edge, as indicated at 54, to the upper pile, and with the other edge to the fixed pile. At, this point the rubber band is threaded in particular through the upper pile, through the lower pile, through the backs and through the spacer.

According to the illustrations, the rubber band can consist of two layers, an inner shorter layer and an outer longer layer, so that the tightness increases in stages. The arrows indicate the introduction of the holder H.

I claim:

1. A cleaning cloth for stretching onto a wiper frame intended for such a cleaning cloth comprising a cloth member having a cleaning surface on one side and being provided on the opposite side with pockets to receive the opposite ends of a wiper frame stretching bow, the cleaning cloth having opposite peripheral edges and having a seam extending along and spaced inwardly from each of the peripheral edges to form an outer stiffening bead which extends along each of the respective peripheral edges of the cleaning cloth, said seam extending between the respective pocket and peripheral edge and forming a tilting articulation for the respective outer stiffening bead.

2. The cleaning cloth as claimed in claim 1 wherein the cleaning cloth member is turned back on itself at least twice at least one edge of the cleaning cloth and stitched between the respective edge of the turned back portion to provide an inner stiffening bead on the side of the seam opposite from the outer stiffening bead, the resulting outer stiffening bead being at least three-layered, and the resulting inner stiffening bead being at least two-layered.

3. The cleaning cloth as claimed in claim 1 wherein the material of the cleaning cloth member is a single material and consists of cloth of natural origin with pile.

4. The cleaning cloth as claimed in claim 2 wherein the inner stiffening bead constitutes an inner spar acted on by the stretching bow of the wiper frame to produce tilting of the stiffening beads.

5. The cleaning cloth as claimed in claim 4 wherein the width of at least one of the inner stiffening bead and the outer stiffening bead amounts to approximately 2 cm.

6. The cleaning cloth as claimed in claim 1 wherein the outer stiffening bead consists of a stiffened part protruding vertically downward from the cloth member.

7. The cleaning cloth as claimed in claim 1 wherein the material of the cloth member includes a knitted support material with a pile which is secured thereon and consists of smooth fibers, to each one of which there is closely associated a sawtooth-shaped fiber.

8. The cleaning cloth as claimed in claim 7 wherein 50% of the sawtooth-shaped fibers are welded in each case to a smooth fiber.

9. The cleaning cloth as claimed in claim 7 wherein some of the fibers consist of cotton.

10. The cleaning cloth as claimed in claim 1 wherein the cleaning cloth has opposite sides and includes a spacer between the opposite sides and a cloth member with a long pile on one side and a cloth member with a short pile on the other side.

11. The cleaning cloth as claimed in claim 10 including a band of elastic material sewn into each of the pockets.

12. The cleaning cloth as claimed in claim 11 wherein the elastic material has a turned-back end which is stitched adjacent the long pile, and another end stitched through the spacer to the short pile.

13. The cleaning cloth as claimed in claim 12 wherein the elastic material comprises two rubber bands with one rubber band being shorter than the other rubber band.

14. A cleaning cloth arrangement comprising a spacer and including two cleaning cloths each as claimed in claim 1 secured on opposite sides of the spacer.

15. The cleaning cloth as claimed in claim 14 wherein the two cleaning cloths have different properties.

16. A cleaning cloth for stretching onto a wiper frame intended for such a cleaning cloth comprising a cloth member having pockets for receiving opposite stretching bow ends of the wiper frame and having a trapezoidal configuration with the longest leg of the trapezoid at the bottom.

* * * * *